US010478666B2

(12) United States Patent
Yoo

(10) Patent No.: US 10,478,666 B2
(45) Date of Patent: Nov. 19, 2019

(54) TREADMILL

(71) Applicant: DRAX INC., Anyang-si (KR)

(72) Inventor: Seon Kyung Yoo, Seoul (KR)

(73) Assignee: Drax Inc., Gyeonggi-do (KR)

( * ) Notice: Subject to any disclaimer, the term of this patent is extended or adjusted under 35 U.S.C. 154(b) by 38 days.

(21) Appl. No.: 15/564,401

(22) PCT Filed: Mar. 31, 2016

(86) PCT No.: PCT/KR2016/003294
§ 371 (c)(1),
(2) Date: Oct. 4, 2017

(87) PCT Pub. No.: WO2016/163680
PCT Pub. Date: Oct. 13, 2016

(65) Prior Publication Data

US 2018/0133544 A1 May 17, 2018

(30) Foreign Application Priority Data

Apr. 8, 2015 (KR) ..... 10-2015-0049956

(51) Int. Cl.
*A63B 22/02* (2006.01)

(52) U.S. Cl.
CPC ..... *A63B 22/0214* (2015.10); *A63B 22/02* (2013.01); *A63B 22/0285* (2013.01)

(58) Field of Classification Search
CPC ..... A63B 2/00; A63B 22/02
See application file for complete search history.

(56) References Cited

U.S. PATENT DOCUMENTS 3,941,377 A * 3/1976 Lie ..... A63B 22/0012 482/70
4,334,676 A * 6/1982 Schonenberger ..... A63B 22/02 482/54

(Continued)

FOREIGN PATENT DOCUMENTS

CN 202892783 U 4/2013
JP 2003-226331 A 8/2003

(Continued)

OTHER PUBLICATIONS

National Intellectual Property Administration, PRC, Office Action, dated Sep. 30, 2018, issued in China Patent Application No. 201680020645.9.

(Continued)

*Primary Examiner* — Garrett K Atkinson
(74) *Attorney, Agent, or Firm* — Klarquist Sparkman, LLP

(57) ABSTRACT

Provided is a treadmill. The treadmill includes a first frame and a second frame that are disposed in parallel with each other and a plurality of slats that extend perpendicularly to a disposition direction of the first frame and the second frame, are disposed between the first frame and the second frame, and are installed to move with respect to the first frame and the second frame, in which at least some of the plurality of slats include a support plate, which includes a base portion providing a first plane and a strength reinforcing portion that has a shape protruding from the base portion and has a cavity formed therein.

11 Claims, 9 Drawing Sheets

(56) References Cited

U.S. PATENT DOCUMENTS 4,509,510 A * 4/1985 Hook ..... A61H 7/001 156/292
4,925,183 A * 5/1990 Kim ..... A63B 22/16 434/61
5,158,073 A * 10/1992 Bukowski ..... A61H 39/04 5/944
5,160,640 A * 11/1992 Badstieber ..... E04G 9/02 249/189
5,250,067 A * 10/1993 Gelfer ..... A61H 39/00 606/185
5,336,145 A * 8/1994 Keiser ..... A63B 22/02 482/51
5,470,293 A * 11/1995 Schonenberger ..... A63B 22/02 198/834
5,527,241 A * 6/1996 Peng ..... A61H 7/001 482/51
5,690,587 A * 11/1997 Gruenangerl ..... A63B 22/02 482/54
6,042,514 A * 3/2000 Abelbeck ..... A63B 22/02 198/439
6,162,150 A * 12/2000 Lee ..... A63B 23/03533 482/51
6,409,633 B1 * 6/2002 Abelbeck ..... A63B 22/02 482/51
6,860,836 B1 * 3/2005 Wu ..... A63B 22/001 198/850
6,918,859 B1 * 7/2005 Yeh ..... A61H 7/001 482/54
7,195,582 B2 * 3/2007 Wu ..... A63B 22/001 198/850
7,510,511 B2 * 3/2009 von Detten ..... A63B 22/02 482/54
7,976,437 B1 * 7/2011 von Detten ..... A63B 22/0235 482/54
8,343,016 B1 * 1/2013 Astilean ..... A63B 21/156 482/54
8,690,738 B1 * 4/2014 Astilian ..... A63B 21/156 482/54
8,986,169 B2 * 3/2015 Bayerlein ..... A63B 21/0053 482/54
9,005,085 B2 * 4/2015 Astilean ..... A63B 22/02 482/54
9,039,579 B1 * 5/2015 Osime ..... A63B 22/14 482/51
9,039,580 B1 * 5/2015 Bayerlein ..... A63B 21/0053 482/54
9,114,276 B2 * 8/2015 Bayerlein ..... A63B 21/0053
9,468,796 B1 * 10/2016 Astilean ..... A63B 21/156
9,675,839 B2 * 6/2017 Dalebout ..... A63B 22/02
2002/0177511 A1 * 11/2002 Jang ..... A61H 15/00 482/146
2005/0221959 A1 * 10/2005 Yeh ..... A61H 7/001 482/54
2007/0275827 A1 * 11/2007 Glaser ..... A63B 21/4037 482/23
2008/0176719 A1 * 7/2008 To ..... A63B 22/0235 482/54
2009/0170666 A1 * 7/2009 Chiang ..... A63B 22/02 482/54
2012/0010053 A1 * 1/2012 Bayerlein ..... A63B 21/0053 482/54
2014/0011642 A1 * 1/2014 Astilean ..... A63B 22/02 482/54
2014/0080679 A1 * 3/2014 Bayerlein ..... A63B 21/0053 482/54
2014/0213419 A1 * 7/2014 Bayerlein ..... A63B 21/0053 482/54
2015/0210348 A1 * 7/2015 Astilean ..... A63B 22/02 280/228
2015/0352400 A1 * 12/2015 Bayerlein ..... A63B 21/0053 482/54
2016/0144225 A1 * 5/2016 Dalebout ..... A63B 22/02 482/54
2016/0166877 A1 * 6/2016 Cei ..... A63B 22/02 482/54
2016/0296789 A1 * 10/2016 Astilean ..... A63B 21/156
2016/0367851 A1 * 12/2016 Astilean ..... B62K 7/00
2018/0140903 A1 * 5/2018 Poure ..... A63B 24/0075
2018/0236291 A1 * 8/2018 Bayerlein ..... A63B 21/0053
2018/0236292 A1 * 8/2018 Bayerlein ..... A63B 21/0053

FOREIGN PATENT DOCUMENTS

KR 20-1992-0008135 Y1 7/1992
KR 10-1996-0004042 B1 3/1996
KR 10-1385004 B1 4/2014

OTHER PUBLICATIONS

World Intellectual Property Organization, International Search Report and Written Report, dated Jul. 7, 2016, issued in International Application No. PCT/KR2016/003294.

* cited by examiner

TREADMILL

TECHNICAL FIELD

The present disclosure relates to a treadmill.

BACKGROUND ART

A treadmill is an exercise machine that gives the effect of walking or running in a small space by using a belt rotating along an infinite orbit, and is also called a running machine. Demands for the treadmill are ever increasing because the treadmill allows users to walk or run indoors at proper temperatures, regardless of the weather.

Recently, to meet various needs of consumers about the treadmill, a new type of treadmill has been developed.

For example, to reproduce the effect of landing on the ground like in a real track, a treadmill having a slat belt structure is under development. The slat belt structure includes two belts arranged in parallel with each other and a plurality of slats that extend perpendicularly to a rotating direction of the belts and are connected between the two belts. Users exercise in contact with the slats in place of the belts, such that the users may feel like exercising in a real track as compared to exercising on an existing treadmill having a simple belt structure.

However, since the slat belt structure has to bear a load of a user and absorb a shock during a user's exercise, a slat having a strength lower than a predetermined level may be excessively bent or damaged.

DETAILED DESCRIPTION OF THE INVENTION

Technical Problem

The present disclosure provides a treadmill which is capable of optimizing a manufacturing cost while securing a strength of a slat.

Technical Solution

A treadmill according to an aspect of the present disclosure includes a first frame and a second frame that are disposed in parallel with each other and a plurality of slats that extend perpendicularly to a disposition direction of the first frame and the second frame, are disposed between the first frame and the second frame, and are installed to move with respect to the first frame and the second frame, in which at least some of the plurality of slats include a support plate, which includes a base portion providing a first plane and a strength reinforcing portion that has a shape protruding from the base portion and has a cavity formed therein.

In an embodiment, the strength reinforcing portion may include an inclined region extending from the base portion inclinedly with respect to the first plane and a planar region extending from the inclined region and providing a second plane that is parallel with the first plane.

In an embodiment, a cross-sectional shape of the strength reinforcing portion may be a trapezoidal shape.

In an embodiment, a cross-sectional shape of the strength reinforcing portion may be any one of a half-elliptic shape, a semi-circular shape, and a polygonal shape.

In an embodiment, the base portion may include an opening that exposes the cavity of the strength reinforcing portion.

In an embodiment, the slat may further include a cover adapted to close the opening.

In an embodiment, the slat may further include a shock-absorbing layer disposed on a surface of the support plate.

In an embodiment, at least one rib may be formed in the cavity.

In an embodiment, the support plate may include any one of plastic and aluminum.

In an embodiment, the plurality of slats may be connected by a first belt and a second belt that have an endless shape.

In an embodiment, the plurality of slats may be connected such that adjacent slats are connected by a link.

Other aspects, features, and advantages of the present disclosure will become apparent from the drawings, the claims, and the detailed description of the present disclosure.

These general and detailed aspects may be carried out by using a system, a method, a computer program, or a combination of a system, a method, and a computer program.

Advantageous Effects of the Invention

With a treadmill according to an embodiment of the present disclosure, by providing a slat including a strength reinforcing portion having a cavity formed therein, a manufacturing cost may be reduced while securing a strength of the slat.

BEST MODE

Figure 1:
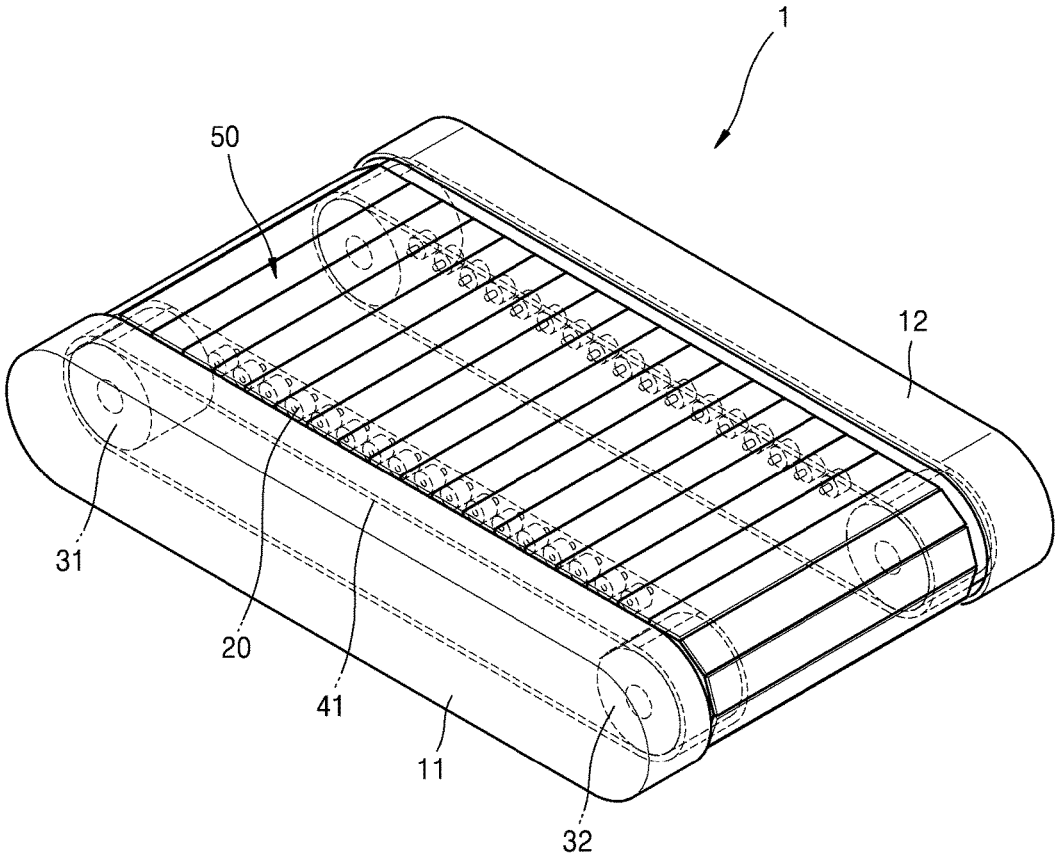
FIG. 1 is a perspective view of a treadmill according to an embodiment of the present disclosure.

Hereinafter, embodiments of the present disclosure will be described in detail with reference to the accompanying drawings. Throughout the drawings, like reference numerals refer to like elements, and each element may be exaggerated in size for clarity and convenience of a description.

Figure 2:
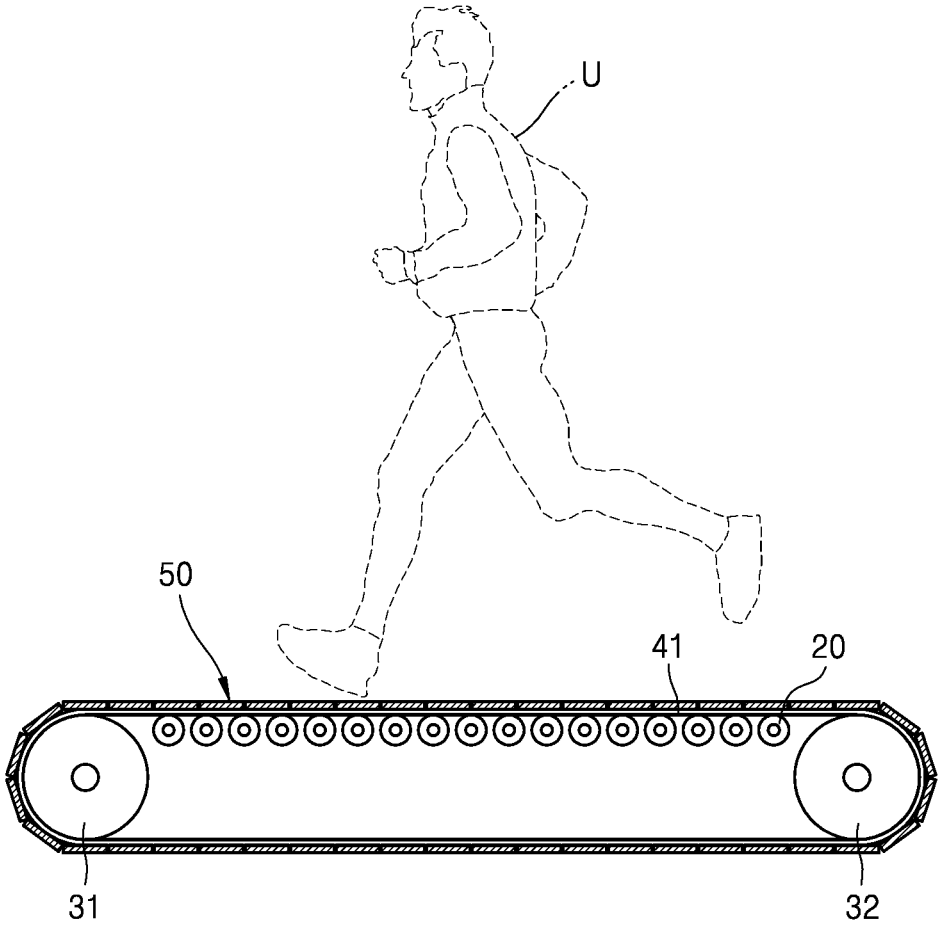
FIG. 2 is a side view of a treadmill shown in FIG. 1.
Figure 3:
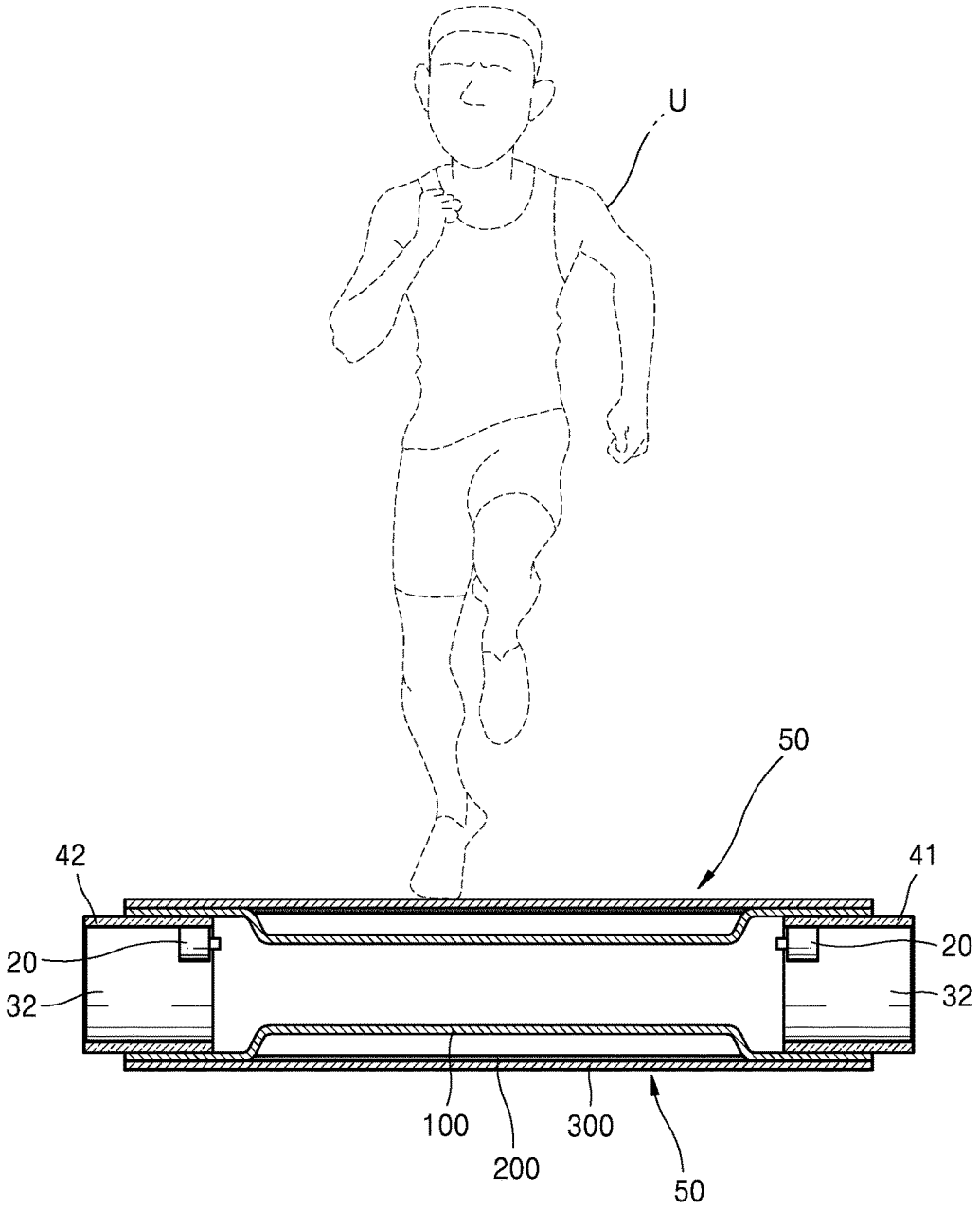
FIG. 3A is a cross-sectional view of a treadmill shown in FIG. 1.
FIG. 3B is a perspective view conceptually illustrating another example of a connection structure of a plurality of slats.
Figure 3A:
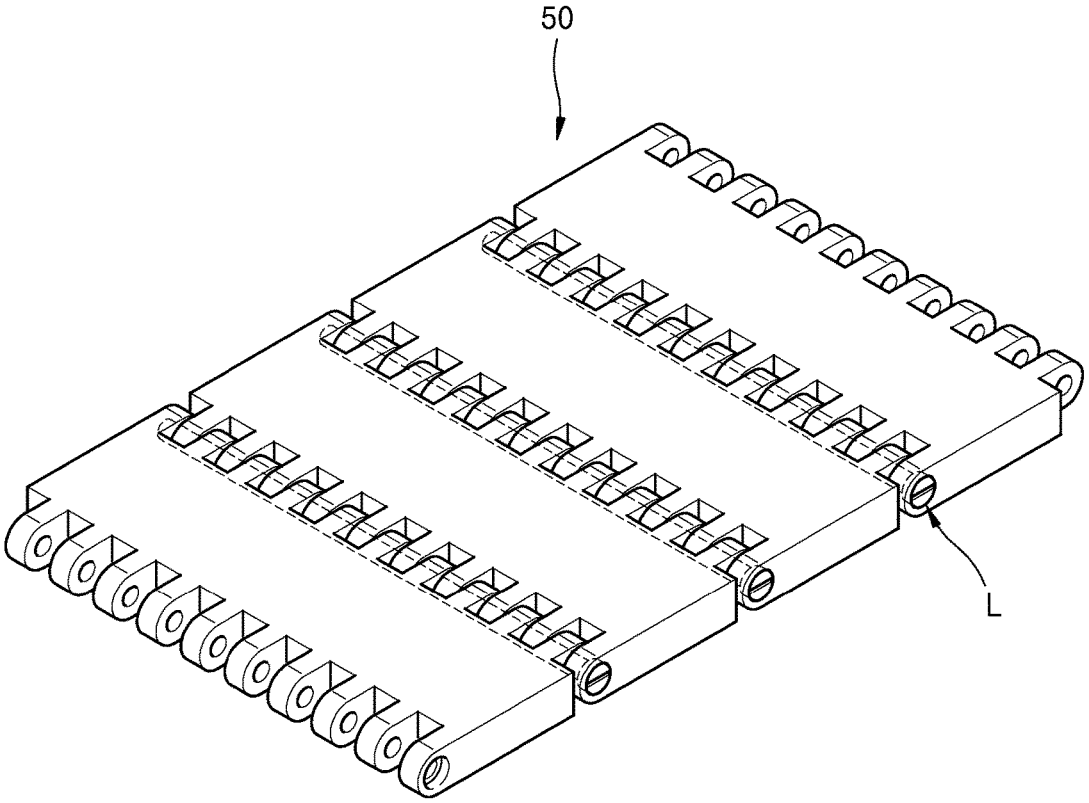

FIG. 1 is a perspective view of a treadmill 1 according to an embodiment of the present disclosure. FIG. 2 is a side view of the treadmill 1 of FIG. 1, and FIG. 3A is a cross-sectional view of the treadmill 1 of FIG. 1. In FIGS. 2 and 3A, for convenience of description, a first frame 11 and a second frame 12 of FIG. 1 will not be shown.

Referring to FIGS. 1 through 3A, the treadmill 1 according to the current embodiment may include the first frame 11, the second frame 12, a plurality of bearings 20, a front roller 31, a rear roller 32, a first belt 41, a second belt 42, and a plurality of slats 50. Herein, the front and the rear will be defined as a front direction and a rear direction with respect to a user U when the user U performs a normal exercise.

The first frame 11 and the second frame 12 are disposed spaced apart from each other in opposite sides. The first frame 11 and the second frame 12 are disposed in parallel to each other. Between the first frame 11 and the second frame 12 may be disposed a plurality of slats 50 and other components (not shown) of the treadmill 1.

A plurality of bearings 20 are provided in each of the first frame 11 and the second frame 12. For example, the bearing 20 may be a ball bearing. The first belt 41, the second belt 42, and the plurality of slats 50 fixedly connected to the first belt 41 and the second belt 42 may rotate by means of the plurality of bearings 20. For example, the plurality of bearings 20 support the first belt 41 and the second belt 42 to allow rotation of the first belt 41 and the second belt 42, such that the plurality of slats 50 fixedly connected to the first belt 41 and the second belt 42 may be supported to rotate by means of the plurality of bearings 20.

The front roller 31 is disposed in a front of each of the first frame 11 and the second frame 12. The rear roller 32 is disposed in a rear of each of the first frame 11 and the second frame 12. The front roller 31 and the rear roller 32 support the first belt 41, the second belt 42, and the plurality of slats 50, together with the bearings 20, to enable rotation of the first belt 41, the second belt 42, and the plurality of slats 50.

The first belt 41 has a rotatable and endless shape. The first belt 41 is disposed to contact the front roller 31, the rear roller 32, and the plurality of bearings 20 provided in the first frame 11. Rotation of the first belt 41 is facilitated by the front roller 31, the rear roller 32, and the plurality of bearings 20.

The second belt 42 has a rotatable and endless shape. The second belt 42 is spaced apart from the first belt 41 and is disposed in parallel with the first belt 41. The second belt 42 is disposed to contact the front roller 31, the rear roller 32, and the plurality of bearings 20 provided in the second frame 12. Rotation of the second belt 42 is facilitated by the front roller 31, the rear roller 32, and the plurality of bearings 20.

The plurality of slats 50 may be arranged in a rotation direction of the first belt 41 and the second belt 42. Each of the plurality of slats 50 may extend perpendicularly to a disposition direction in which the first frame 11 and the second frame 12 are disposed. For example, each of the plurality of slats 50 extends perpendicularly to the rotation direction of the first belt 41 and the second belt 42, and opposite ends of each slat 50 may be fixed and connected by the first belt 41 and the second belt 42.

As such, the plurality of slats 50 may be installed in the first frame 11 and the second frame 12 to move by means of the plurality of bearings 20, the front roller 31, the rear roller 32, the first belt 41, and the second belt 42.

Meanwhile, the first belt 41 and the second belt 42 disposed on opposite ends have been described as a connection structure of the plurality of slats 50 in the foregoing embodiment, but the connection structure may be modified variously without being limited to this example. For example, without using the first belt 41 and the second belt 42, adjacent slats 50 may be connected by a link L, as shown in FIG. 3B.

A user U exercises while being on the slats 50 that may move with respect to the first frame 11 and the second frame 12. The slat 50 bears a load of the user U and rotates by means of the first belt 41 and the second belt 42 fixedly connected to opposite ends of the slat 50.

As such, when the plurality of slats 50 rotate while supporting the load of the user U, the slats 50 need to have enough strength to endure not only the load of the user U, but also a shock generated during exercise. In the case of designing without considering the strength of the slat 50, the slat 50 may be excessively bent or damaged by the load of the user U or a shock generated during exercise, causing anxiety or injury to the user U.

Meanwhile, to reinforce the strength of the slat 50, the entire thickness of the slat 50 may be increased, but in this case, an unnecessary part also becomes thick, increasing the manufacturing cost.

In the treadmill 1 according to the current embodiment, structures of at least some of the plurality of slats 50 will be improved to reduce the material cost of the slat 50 while reinforcing the strength of the slat 50. Hereinbelow, an improved structure of the slats 50 will be described in detail.

Figure 4A:
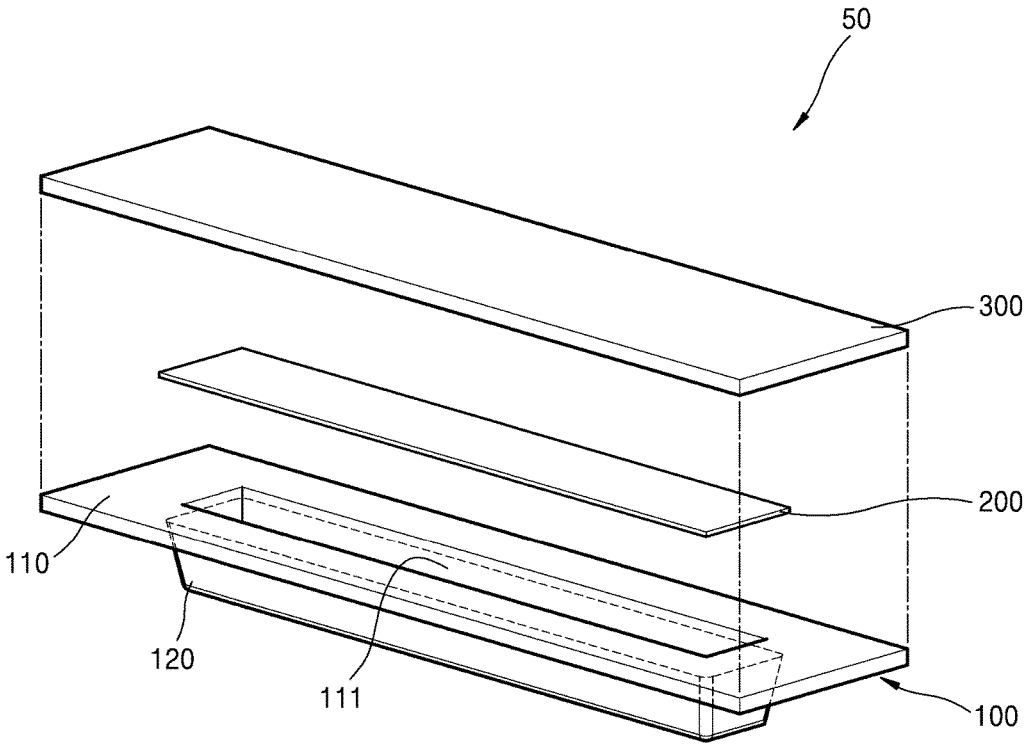
FIGS. 4A and 4B are an exploded perspective view and an assembled perspective view of a slat according to an embodiment of the present disclosure.
Figure 4B:
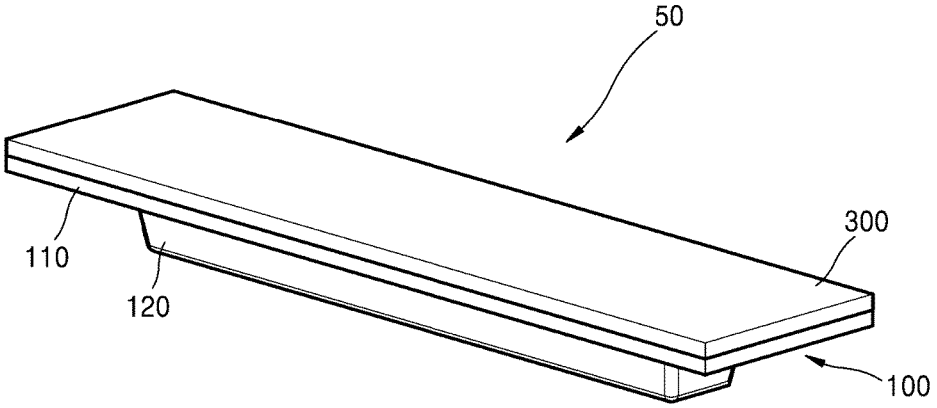
Figure 5A:
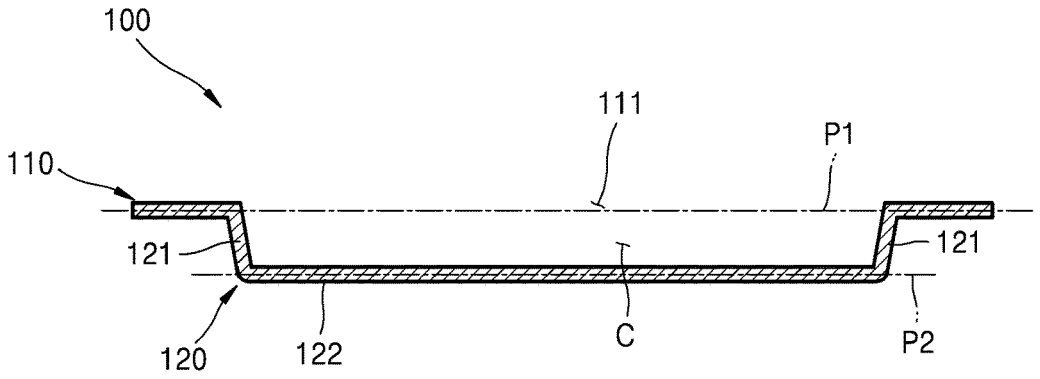
FIGS. 5A and 5B are cross-sectional views of a support plate, cut along different directions.
Figure 5B:
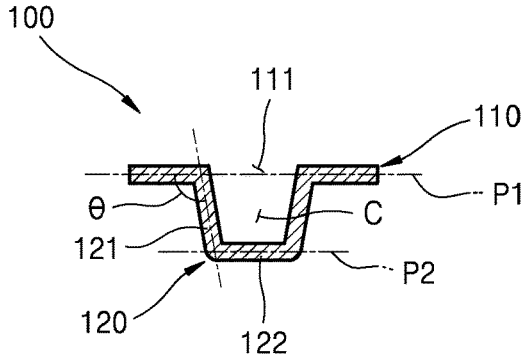
Figure 5C:
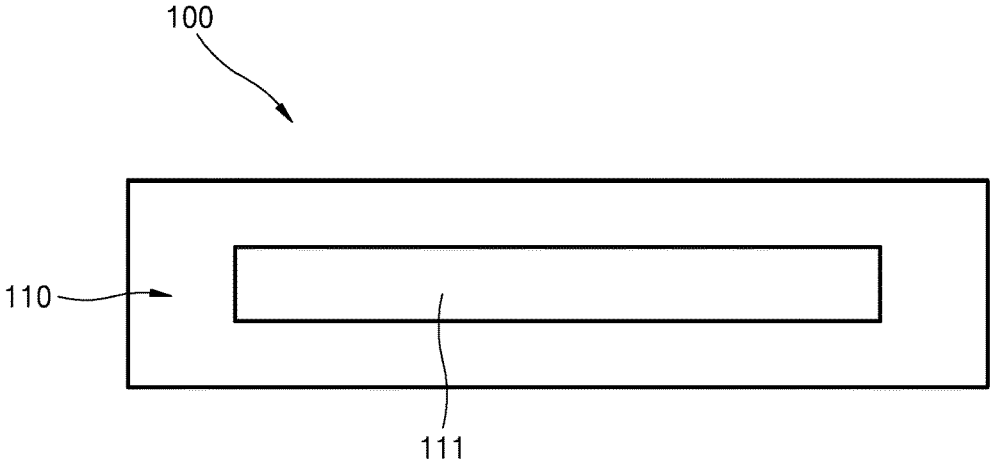
FIG. 5C is a top plane view of a support plate.

FIGS. 4A and 4B are an exploded perspective view and an assembled perspective view of the slat 50 according to an embodiment of the present disclosure. FIGS. 5A and 5B are cross-sectional views of a support plate 100, cut along different directions, and FIG. 5C is a top plane view of the support plate 100. Referring to FIGS. 5A through 5C, the slat 50 includes the support plate 100 and a shock-absorbing layer 300 that covers a surface of the support plate 100.

The support plate 100 includes a base portion 110 providing a first plane P1 and a strength reinforcing portion 120 that has a shape protruding from the base portion 110 and has a cavity C formed therein.

In the support plate 100, the base portion 110 and the strength reinforcing portion 120 may be formed integrally. The support plate 100 may include a moldable material, e.g., a material that allows injection molding, extrusion molding, or compression molding. For example, the support plate 100 may include plastic or aluminum.

A cross-sectional shape of the strength reinforcing portion 120 may be a trapezoid. The strength reinforcing portion 120 includes an inclined region 121 extending, from the base portion 110, inclinedly with respect to a first plane P1 provided by the base portion 110, and a planar region 122 that extends from the inclined region 121 and provides a second plane P2 that is parallel with the first plane P1 provided by the base portion 110. For example, an angle θ between the inclined region 121 and the first plane P1 of the base portion 110 may be an obtuse angle. In another example, the angle θ between the inclined region 121 and the first plane P1 of the base portion 110 may be a right angle. An angle between the second plane P2 of the planar region 122 and the first plane P1 of the base portion 110 may be a straight angle.

As such, the support plate 100 is designed to have the second plane P2 that is parallel with the first plane P1 of the base portion 110 by means of the strength reinforcing portion 120, increasing a section modulus and designing a neutral line away from the first plane P1. For example, a position of the neutral line of the support plate 100 may move to a middle point between the first plane P1 and the second plane P2. Thus, the material of the support plate 100 may be saved while reinforcing the strength of the support plate 100 with respect to the load of the user U and the shock.

Moreover, through designing where the inclined region 121 of the strength reinforcing portion 120 has an obtuse angle with the first plane P1 of the base portion 110, an air resistance of the strength reinforcing portion 120 may be minimized when the support plate 100 moves. Hence, noise may be reduced during an operation of the treadmill 1.

Figure 6A:
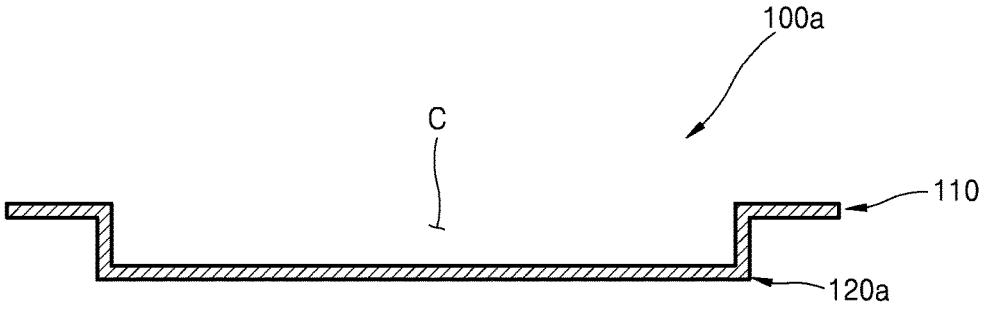
FIGS. 6A and 6B are cross-sectional views of a support plate according to other embodiments of the present disclosure.
Figure 6B:
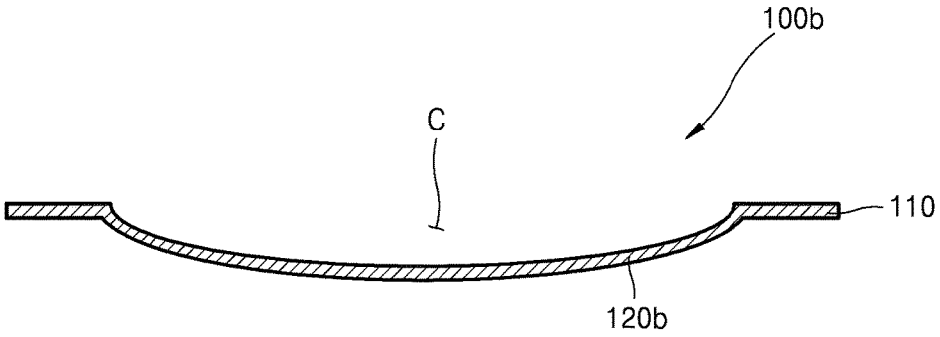

The foregoing embodiment has been described based on an example where the cross-sectional shape of the strength reinforcing portion 120 is a trapezoid. However, the cross-sectional shape of the strength reinforcing portion 120 may vary without being limited to a trapezoid. For example, the cross-sectional shape of the strength reinforcing portion 120 may be a polygonal shape, e.g., a rectangular shape as shown in FIG. 6A, as well as a trapezoidal shape. In another example, the cross-sectional shape of the strength reinforcing portion 120 may be a curved shape, e.g., a semi-elliptic shape as shown in FIG. 6B, or a semi-circular shape not shown in the drawings.

Referring back to FIGS. 4A, 5A, and 5B, the base portion 110 of the support plate 100 may include an opening 111 that exposes the cavity C. The opening 111 may have a size corresponding to a planar size of the strength reinforcing portion 120. With the opening 111, the support plate 100 where the base portion 110 and the strength reinforcing portion 120 are formed integrally may be manufactured by compression molding.

The shock-absorbing layer 300 may be disposed on at least a surface of the support plate 100. The shock-absorbing layer 300 may directly contact the user U. The shock-absorbing layer 300 absorbs a part of a shock exerted on the slat 50 during exercise of the user U and alleviates the shock the user U feels. The shock-absorbing layer 300 may include a material having elasticity to absorb a shock, e.g., rubber.

The slat 50 may further include a cover 200 disposed between the shock-absorbing layer 300 and the support plate 100. The cover 200 may close the opening 111 of the support plate 100. By closing the opening 111 using the cover 200, the shock-absorbing layer 300 may be prevented from being inserted into the cavity C during a manufacturing process. A material of the cover 200 may be, but not limited to, plastic, and may be variously modified if the material is capable of closing the opening 111 of the support plate 100.

Figure 7A:
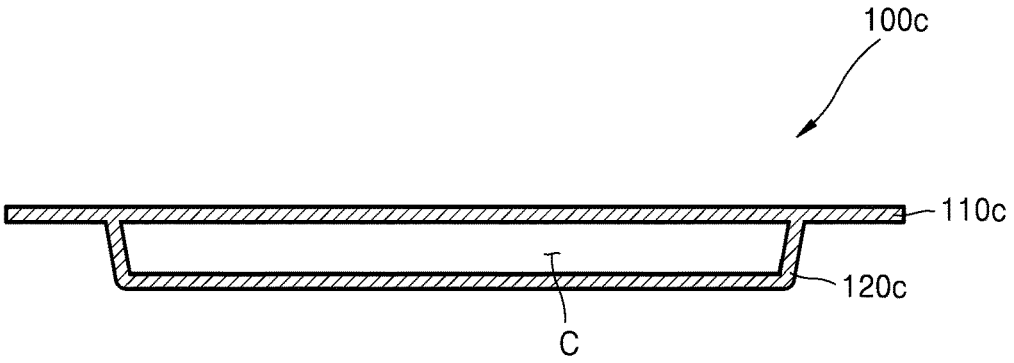
FIGS. 7A and 7B are respectively a cross-sectional view and a perspective view of a support plate according to another embodiment of the present disclosure.
Figure 7B:
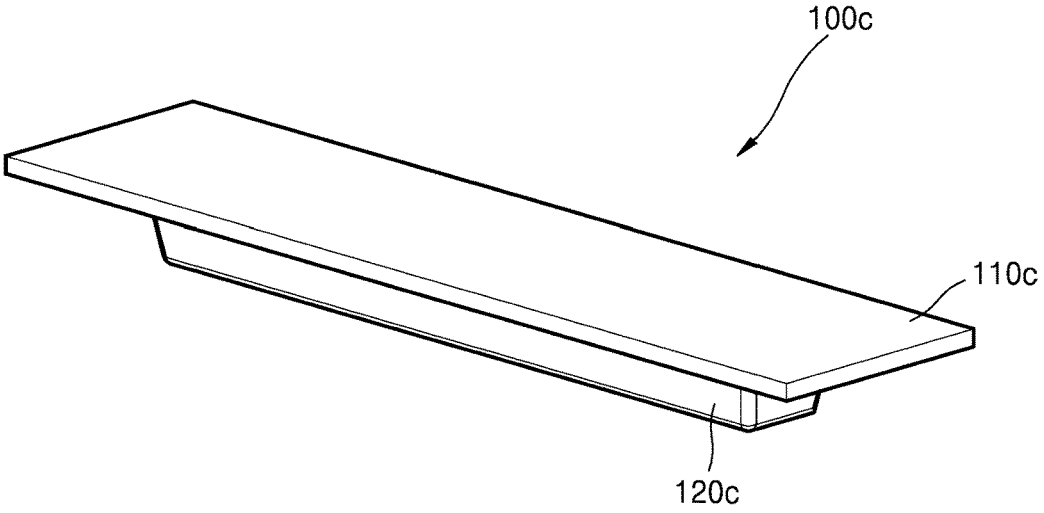

FIGS. 7A and 7B are respectively a cross-sectional view and a perspective view of a support plate 100*c* according to another embodiment of the present disclosure. Referring to FIGS. 7A and 7B, the support plate 100*c* includes a base portion 110C providing the first plane P1 that is supportable by the user U and a strength reinforcing portion 120*c* that has a shape protruding from the base portion 110*c* and has the cavity C formed therein.

The support plate 100*c* may not include the opening 111 unlike the foregoing embodiment described with reference to FIG. 4A. By using a three-dimensional (3D) printing scheme, the support plate 100*c* having the strength reinforcing portion 120*c* having the cavity C formed therein may be manufactured without forming the opening 111.

Since the opening 111 is not formed in the support plate 100*c*, the slat 50 may not include the cover 200 between the support plate 100*c* and the shock-absorbing layer 300.

Figure 8A:
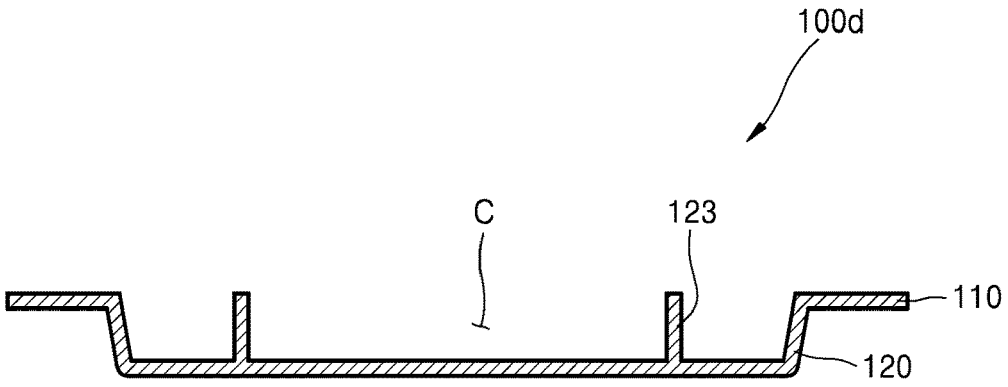
FIGS. 8A and 8B are respectively a cross-sectional view and a top plane view of a support plate according to another embodiment of the present disclosure.
Figure 8B:
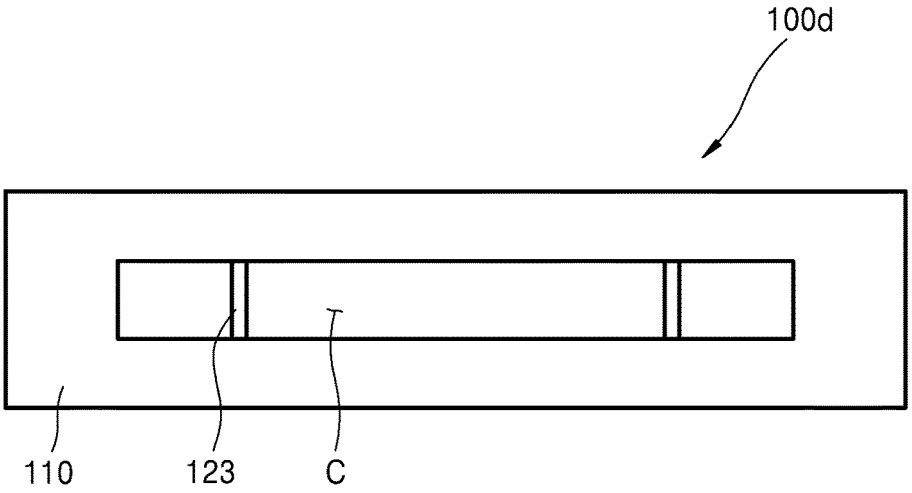

FIGS. 8A and 8B are respectively a cross-sectional view and a perspective view of a support plate 100*d* according to another embodiment of the present disclosure. Referring to FIGS. 8A and 8B, the support plate 100*d* includes the base portion 110 providing the first plane P1 supportable by the user U and the strength reinforcing portion 120 that has a shape protruding from the base portion 110 and has a cavity C formed therein.

In the cavity C of the strength reinforcing portion 120, at least one rib 123 may be formed. For example, two ribs 123 may be formed in the cavity C. The ribs 123 may be parallel with a moving direction of the slat 50. By forming the ribs 123, the shape of the cavity C may be maintained. By forming the ribs 123, a section modulus of the slat 50 may be further increased.

Meanwhile, the foregoing embodiment has been described based on an example where the plurality of bearings 20 provided in the first frame 11 and the second frame 12 are arranged along a strength line. However, the arrangement of the plurality of bearings 20 of the treadmill 1 according to the present disclosure may also be modified. For example, the plurality of bearings 20 may be arranged such that the shape of a center of the plurality of bearings 20 is dented.

Also, the treadmill 1 according to the current embodiment may not include a separate driving source for rotating the first belt 41 and the second belt 42. That is, the treadmill 1 may be a non-powered treadmill rotating by means of legs of the user U. However, the treadmill 1 according to the present disclosure is not limited to the non-powered treadmill, and may also be a powered treadmill including a separate driving source.

Other aspects, features, and advantages of the present disclosure will become apparent from the drawings, the claims, and the detailed description of the present disclosure. These general and detailed aspects may be carried out by using a system, a method, a computer program, or a combination of a system, a method, and a computer program.

The invention claimed is:

1. A treadmill comprising:

a first frame and a second frame that are disposed in parallel with each other; and a plurality of slats that extend perpendicularly to a disposition direction of the first frame and the second frame, are disposed between the first frame and the second frame, and are installed to move with respect to the first frame and the second frame, wherein at least some of the plurality of slats comprise a support plate, which comprises a base portion providing a first plane for supporting a user and a strength reinforcing portion that extends from the base portion, wherein the strength reinforcing portion is a convex shape and has a cavity formed therein.

2. The treadmill of claim 1, wherein the strength reinforcing portion comprises an inclined region extending from the base portion inclinedly with respect to the first plane and a planar region extending from the inclined region and providing a second plane that is parallel with the first plane.

3. The treadmill of claim 1, wherein a cross-sectional shape of the strength reinforcing portion is a trapezoidal shape.

4. The treadmill of claim 1, wherein a cross-sectional shape of the strength reinforcing portion is any one of a half-elliptic shape, a semi-circular shape, and a polygonal shape.

5. The treadmill of claim 1, wherein the base portion comprises an opening that exposes the cavity of the strength reinforcing portion.

6. The treadmill of claim 5, wherein the slat further comprises a cover adapted to close the opening.

7. The treadmill of claim 1, wherein the slat further comprises a shock-absorbing layer disposed on a surface of the support plate.

8. The treadmill claim 1, wherein at least one rib is formed in the cavity.

9. The treadmill of claim 1, wherein the support plate comprises plastic or aluminum.

10. The treadmill of claim 1, further comprising:

first and second endless belts fixedly attached to respective first and second ends of each of the plurality of slats and positioned to circulate in a closed path extending around a front roller and a rear roller, the closed path comprising an upper exercise segment extending between the front roller and the rear roller, and first and second bearing arrays each having a plurality of hearings stationarily mounted to support the first and second endless belts and the slats from below as the first and second endless belts and slats circulate along the upper exercise segment of the closed path.

11. The treadmill of claim 1, wherein the plurality of slats are connected such that adjacent slats are connected by a link.

* * * * *